US010856718B2

(12) United States Patent
Kollmann

(10) Patent No.: US 10,856,718 B2
(45) Date of Patent: Dec. 8, 2020

(54) CLEANING SYSTEM FOR CLEANING FLOORS

(71) Applicant: Josef Kollmann, Fulda/OT Niederrode (DE)

(72) Inventor: Josef Kollmann, Fulda/OT Niederrode (DE)

( * ) Notice: Subject to any disclaimer, the term of this patent is extended or adjusted under 35 U.S.C. 154(b) by 79 days.

(21) Appl. No.: 16/334,322

(22) PCT Filed: Sep. 25, 2017

(86) PCT No.: PCT/EP2017/074178

§ 371 (c)(1),
(2) Date: Mar. 18, 2019

(87) PCT Pub. No.: WO2018/060115

PCT Pub. Date: Apr. 5, 2018

(65) Prior Publication Data

US 2019/0200835 A1 Jul. 4, 2019

(30) Foreign Application Priority Data

Sep. 27, 2016 (DE) ..... 10 2016 118 256

(51) Int. Cl.
*A47L 13/60* (2006.01)
*A47L 13/256* (2006.01)
(Continued)

(52) U.S. Cl.
CPC ..... *A47L 13/60* (2013.01); *A47L 13/256* (2013.01); *A47L 13/258* (2013.01); *A47L 13/51* (2013.01); *A47L 13/58* (2013.01); *A47L 13/59* (2013.01)

(58) Field of Classification Search
CPC ..... A47L 13/258; A47L 13/51; A47L 13/58; A47L 13/59; A47L 13/14; A47L 13/60; A47J 47/18; D06F 45/00; A45D 6/00
(Continued)

(56) References Cited

U.S. PATENT DOCUMENTS 6,158,258 A * 12/2000 Bowman ..... A47L 13/60 134/191
7,254,863 B1 8/2007 Morad
2015/0190030 A1 7/2015 Johnson

FOREIGN PATENT DOCUMENTS

CA 2993591 A1 * 12/2017 ..... A47L 13/60
WO 03/088803 A1 10/2003

* cited by examiner

*Primary Examiner* — Mark Spisich
*Assistant Examiner* — Katina N. Henson
(74) *Attorney, Agent, or Firm* — Stuart H. Mayer; Mayer & Williams PC

(57) ABSTRACT

A cleaning system includes a container with a base surface, a top edge, an opening, and side walls integrally formed on the base surface, and designed for holding a cleaning liquid. A mop carrier has a carrier plate, an articulated joint, and a rod handle fastened to the articulated joint. A wringer has a wringing roller, a housing partially enclosing the wringing roller, and a shaft is attached to the housing with an operating handle. On the housing, guide elements are formed leaving a feedthrough gap between the wringing roller and the guide elements, the gap width of which is adjusted to the thickness of the carrier plate of the mop carrier fitted with a mop cover. The wringer is mountable on the carrier plate of the mop carrier and is displaceable thereon in the direction of the base surface, while the mop carrier is fixed in a mop carrier holder.

10 Claims, 6 Drawing Sheets

(51) Int. Cl.

| | |
|---|---|
| ***A47L 13/258*** | (2006.01) |
| ***A47L 13/51*** | (2006.01) |
| *A47L 13/58* | (2006.01) |
| *A47L 13/59* | (2006.01) |

(58) Field of Classification Search
USPC ..... 15/260, 262; 134/195, 191; 68/213
See application file for complete search history.

CLEANING SYSTEM FOR CLEANING FLOORS

BACKGROUND OF THE INVENTION

The invention relates to a cleaning system for cleaning floors, as used for wet cleaning of floors. The cleaning system comprises, in the manner of a set, multiple mutually coordinated, functionally cooperating components, namely, a container for holding a cleaning liquid, a mop carrier, and a wringer.

U.S. Pat. No. 2,851,710 describes a wringer device that is placed in a stationary bucket having a circular cross section, and a mop that is coordinated with the wringer device and is fixedly connected to a rod handle in a predetermined position, for which reason the mop has only limited use underneath furniture having a low floor clearance. This combination has the further disadvantage that the bucket must be carried from one location to another, which may result in spillage of cleaning liquid and has adverse ergonomic effects.

EP 2 769 660 A1 discloses a mop having a rectangular carrier plate that is centrally connected to a rod handle via an articulated joint, and along its longitudinal side is foldable toward the rod handle. The rod handle also has a device that is designed for wringing a carrier plate that is fitted with a mop cover. For this purpose, the device is moved up and down along the rod handle by means of a hand-operated rod linkage. A mutually attracting pair of magnets, one on the carrier plate and one on the rod handle, is used as a securing element for retaining the carrier plate in the folded-up position. The mop has the disadvantage that the device present on its rod handle for wringing out has a thick design, so that it is not possible to mop underneath furniture having a low floor clearance. A container, specifically adapted to the mop, for holding cleaning liquid is not described.

U.S. Pat. No. 6,158,258 describes a rinsing system for cleaning soiled textiles for surface cleaning, and a container that is compatible with same. In the system, nozzles are used via which the cleaning liquid is sprayed onto the soiled textiles in order to clean them. The nozzles are situated in a capped container. The system has a complex design, which is disadvantageous for the system cleaning and maintenance.

US 2003/0217428 A1 discloses a cleaning device having a container and a wringer device that is mounted on the container. An actuator is present on the wringer device in order to wring out a mop. In this cleaning device, the mop must be held in the wringer device with one hand, while the other hand activates the wringer actuator.

WO 97/10742 A1 describes a device by means of which liquid is removed from a mop, using a side of a flat plate that is covered with a sponge. Different embodiments of the fixing of the device to different containers or container receptacles are disclosed which use very different mountings.

The above-mentioned devices have wringer devices that are matched either to a container or to a mop. The wringer device for which matching to a container is not taken into account must provide fastening systems for a plurality of differently designed containers or container receptacles, which requires a wide variety of such devices. This results in a high level of manufacturing effort. The wringer devices, which are fastened to a mop, often restrict handling of the mop, in particular when mopping underneath furniture having a low floor clearance. Other systems lack the ergonomic relief of load when moving over a surface to be cleaned. Practically all cleaning systems known thus far require handling with two hands, which involves ergonomic limitations and usually also has adverse effects on the achievable working speed during the cleaning process.

Proceeding from the prior art, the object of the present invention is to provide a cleaning system for cleaning floors that is operable with one hand and in an ergonomically advantageous manner, is cost-effective to manufacture, and allows high working speeds, in particular in the professional cleaning services sector.

SUMMARY OF THE INVENTION

This object is achieved by a cleaning system according to the invention for cleaning floors according to appended Claim 1.

The cleaning system according to the invention is designed for damp cleaning of surfaces, in particular floors. The cleaning system, as mutually coordinated and compatible components, includes a container, a mop carrier, and a wringer. The container has a base surface at the bottom, and a top edge at the top having an opening that extends essentially over the entire container cross section. Side walls that are preferably designed as one piece, but which in any case are liquid-tight, are integrally formed on the base surface. The container is thus designed for holding liquids, preferably cleaning liquids.

A first side wall section of the container has a wringer holder. A mop carrier holder for the mop carrier is formed on a second side wall section. The side wall sections may be situated next to one another, or preferably opposite one another. Wheels and optionally support feet are situated on a bottom side of the base surface. At least two of the wheels that are present are situated below the first side wall section. This is the section that bears the wringer holder.

The mop carrier has a carrier plate with a top side and a bottom side on which a mop cover may be mounted. In addition, the mop carrier has an articulated joint and a rod handle that is fastened to the articulated joint. The carrier plate is designed for accommodating the mop cover that covers the bottom side of the carrier plate in the mop insert. The mop cover has a mop side that faces the floor, and has an oppositely facing receiving side with holding pockets for fastening the mop cover to the carrier plate. A retaining means is situated on the top side of the carrier plate. The retaining means has a shape that conforms to the mop carrier holder, so that the mop carrier is guidable and fixable in the mop carrier holder.

The wringer includes a wringer roller and a housing that partially encloses the wringer roller. A shaft with a handle is fastened to the housing. In addition, guide elements are provided on the housing in such a way that a feedthrough gap remains between the wringer roller and the guide elements. The feedthrough gap is adapted to the thickness of the carrier plate of the mop carrier that is fitted with the mop cover. The wringer is thus mountable on the carrier plate of the mop carrier, and is displaceable on same in such a way that the wringer roller presses the mop cover against the carrier plate when the mop carrier is relatively moved through the feedthrough gap. During operation, the mop carrier is fixed in the mop carrier holder so that for wringing out, the wringer on the carrier plate of the mop carrier may be displaced in the direction of the base surface of the container.

During the mopping operation, the wringer is placeable in a form-fit manner in the wringer holder, so that a force introduced at the handle of the wringer causes the container to swivel. The swiveling, which may also be referred to as tilting of the container, takes place about a rotational axis that extends along the wheel axle of at least two of the wheels that are situated below the first side wall section. In the swiveled position of the container, the cleaning system is movable on the floor, for which purpose the user needs only one hand.

One advantage of the cleaning system according to the invention for cleaning floors is that the cleaning system may be handled with one hand and operated in an ergonomically advantageous manner. That is, in addition to moving the cleaning system to a different location, with the cleaning system it is also possible to carry out the handling during wetting, rinsing, and wringing of the mop cover on the mop carrier with one hand. In addition, it is possible to operate the cleaning system without significant stooping. The cleaning system according to the invention represents an optimization of the work equipment for cleaning floors, thus improving the conditions for the user.

By use of the cleaning system according to the invention, the activities that are necessary for cleaning the floor are perceived as physically comfortable. In particular, the unrestricted use of the mop carrier, even underneath furniture having a low floor clearance, is advantageous in combination with the other system components. Such a system offering has the further advantage that the varietal uniformity minimizes the manufacturing effort, advantageously resulting in lower manufacturing costs.

In one preferred embodiment, the cleaning system for cleaning floors has a dirt separator. The dirt separator is detachably placed on a base surface top side of the container. Spacers facing the base surface top side of the container are integrally formed on the dirt separator. The dirt separator is designed as a separating plate having separating plate openings. The separating plate openings may be provided as holes or slots. The separating plate has a design, at least in part, as a screen. The dirt rinsed from the mop carrier falls through the separating plate openings and onto the base surface top side of the container, and remains there until the cleaning liquid is replaced. During further rinsing operations, the mop carrier comes into contact only with the separating plate, not with the dirt that is deposited on the base surface top side of the container. As a result, the dirt can deposit on the base surface top side without being swirled up once again and depositing in the mop cover. The dirt separator may therefore also be regarded as a filter.

In one preferred embodiment, the container has at least one handle on at least one side wall. Two handles are particularly preferably situated on opposite side wall sections. The at least one handle is used for raising the container, for example to allow it to be carried up stairs.

In one preferred embodiment of the cleaning system according to the invention, the wringer holder is designed as a protrusion that is formed as one piece in the first side wall section of the container. The protrusion is particularly preferably situated toward the top edge of the container. The protrusion for the wringer holder has its greatest extension parallel to the top edge of the container in order to enclose the wringer roller along its rotational axis. The perpendicular extension of the protrusion of the wringer holder is formed in accordance with the size of the wringer roller diameter together with the housing that partially surrounds the wringer roller, in order to allow a lateral mounting.

In one preferred embodiment, the mop carrier holder is formed as a recess that is introduced into the second side wall section of the container. The recess has a slotted design, and is adapted to the dimensions of the retaining means of the carrier plate. The slotted recess preferably extends from the top edge to a depth in the side wall that is necessary to completely fix the retaining means of the carrier plate therein.

In one preferred embodiment, at least two wheels along a shared rotational axis and two support feet opposite from same are mounted on the bottom side of the base surface of the container. The support feet are spaced apart from the rotational axis of the wheels, and ensure stable standing of the container. The support feet may also be designed as additional wheels, at least one of the additional wheels having a lockable design. It has proven advantageous for at least one of the wheels of the cleaning system to have a locking brake to prevent the container from inadvertently rolling away.

In one preferred embodiment, the articulated joint for connecting the carrier plate to the rod handle of the mop carrier is designed as a double joint, particularly preferably as a Cardan joint. Also preferred are further articulated joints on the carrier plate for dividing the carrier plate into a first and a second carrier plate section, referred to below as at least one carrier plate joint. At least one further carrier plate joint is particularly preferably provided in parallel to the shorter sides of the carrier plate. Folding down the carrier plate into the two carrier plate sections is made possible by the carrier plate joint. The folded-down position of the carrier plate is advantageous for accommodating the mop cover, which thus reduces the longitudinal extension of the carrier plate. The mop cover is fastenable in a receiving gap between the top side and the bottom side of the carrier plate. To clean the floor, the carrier plate is folded back up so that both carrier plate sections lie in one plane and the bottom side of the mop cover is spanned.

In one preferred embodiment, the carrier plate has a multipart, particularly preferably a three-part, design, and has a third, a fourth, and a fifth carrier plate section that are joined by detachable connections. The detachable connections are preferably designed as plug-in connections on the carrier plate sections, between which a receiving gap for accommodating a mop carrier is formed. The connecting means of the third carrier plate section are complementary to the connecting means of the respective fourth and fifth carrier plate section. The fourth and fifth carrier plate sections are designed for accommodating the mop cover. The retaining means for fixing the mop carrier in the mop carrier holder is situated on a top side of the third carrier plate section.

In one preferred embodiment, each of the guide elements of the wringer has at least one guide roller that is situated opposite from and in parallel to the wringer roller. Due to the guide rollers, a desired counterpressure with respect to the wringer roller is generated on the carrier plate fitted with the mop cover, which squeezes out the excess cleaning liquid from the mop cover. Since the wringer roller is preferably made of an elastic material, the contact surface of the wringer roller, which presses the mop cover under the counterpressure of the guide rollers, is increased.

The container, the wringer, and portions of the mop carrier are made, at least in part, of materials of the nonmetal materials group, particularly preferably plastic. Metallic materials are also usable, depending on the requirements for stability of the cleaning system.

DESCRIPTION OF THE DRAWINGS

Further advantages, details, and refinements of the invention result from the following description of preferred embodiments, with reference to the drawings, which show the following.

DETAILED DESCRIPTION OF THE INVENTION

Figure 1:
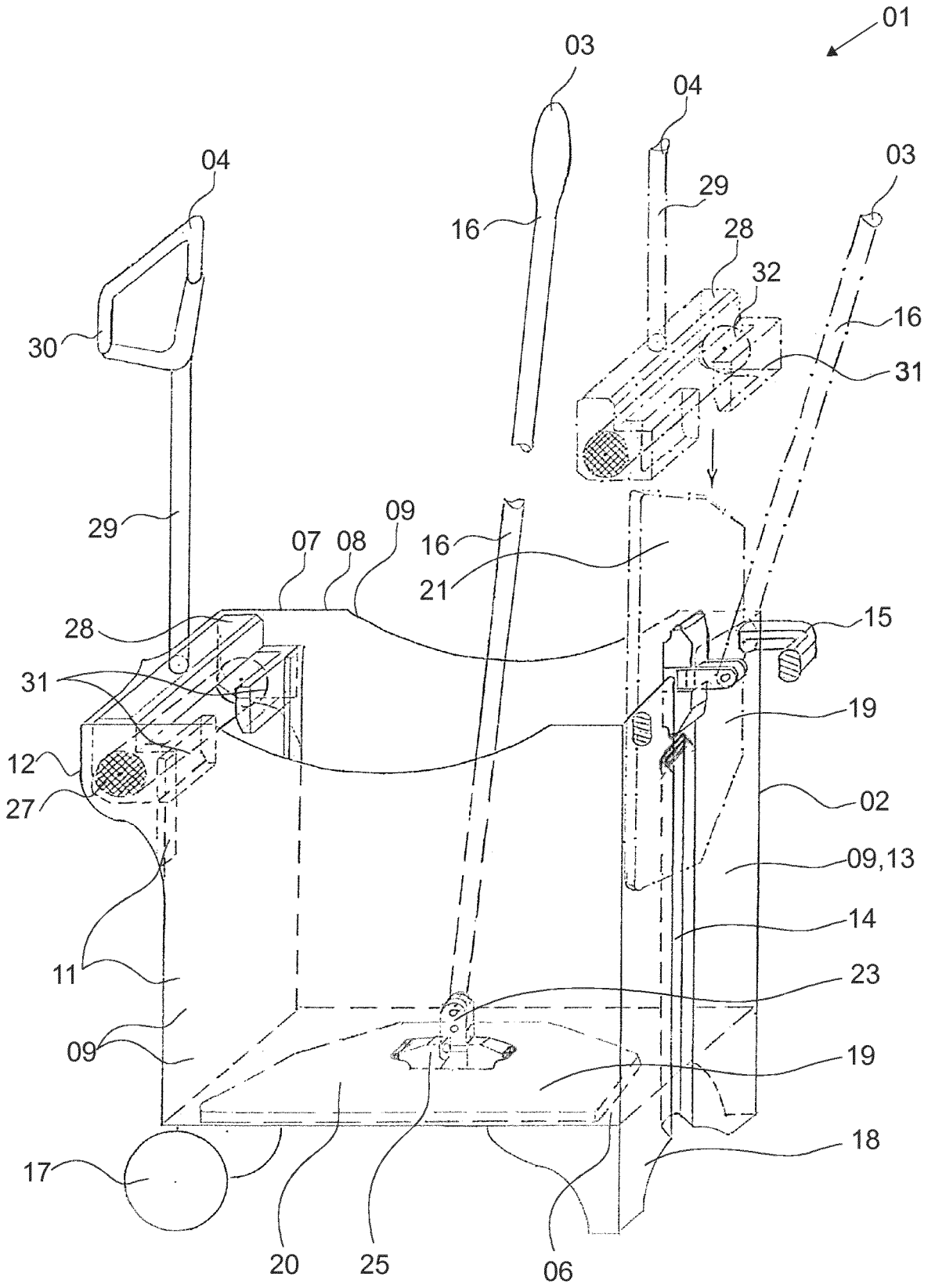
FIG. 1 shows a perspective view of a preferred embodiment of a cleaning system according to the invention for cleaning floors.

FIG. 1 shows a perspective view of a preferred embodiment of a cleaning system 01 according to the invention for cleaning floors. For this purpose, the cleaning system 01 includes a container 02 for holding a cleaning liquid, a mop carrier 03, and a wringer 04. The container 02 has a base surface 06 at the bottom, and a top edge 07 at the top which extends along an opening 08. Side walls 09 that are designed as one piece are integrally formed on the base surface 06. The side walls 09 have a first side wall section 11 with a wringer holder 12, and a second side wall section 13 with a mop carrier holder 14. In the embodiment shown in FIG. 1, the first side wall section 11 is situated opposite from the second side wall section 13. The wringer holder 12 is designed as a protrusion on the first side wall section 11, beginning at the top edge 07. Due to the at least partial continuation of a wall section of the first side wall section 11, the wringer holder 12 is delimited with respect to the interior of the container, so that the wringer holder provides support surfaces for the wringer on all sides except at the top.

The mop carrier holder 14 is designed as a slotted indentation having a bow-shaped handle 15 that is integrally formed on the outside of the container 02. The bow-shaped handle 15 prevents a rod handle 16 of the mop carrier 03 from being folded downwardly; the rod handle 16 comes to rest on the bow-shaped handle when the mop carrier 03 is inserted into the mop carrier holder 14.

The container 02 has two wheels 17 and two support feet 18 on a bottom side of the base surface 06. The wheel axes of the two wheels 17 are coaxially aligned, thus defining a shared rotational axis (not shown) that extends beneath the first side wall section 11 bearing the wringer holder 12. The support feet 18 are situated on the opposite side of the container 02, beneath the second side wall section 13. In the illustrated unswiveled position of the container 02, even and secure standing relative to a flat standing surface is ensured by the support feet 18.

The mop carrier 03 includes a carrier plate 19 having a top side 20 and a bottom side 21. In the state of use, the mop carrier bears a mop cover 22 (shown in FIGS. 3 and 4). In addition, the mop carrier 03 has an articulated joint 23 and the rod handle 16, which is fastened to the articulated joint 23. A retaining means 25 that is subsequently connected to the articulated joint 23 is centrally provided on the top side 20 of the carrier plate 19. The retaining means 25 has a design that is complementary to the slotted indentation in the mop carrier holder 14.

The wringer 04 includes a wringer roller 27. The wringer roller 27 is partially enclosed by a housing 28. A shaft 29 having an operating handle 30 is fastened to the housing 28. Two guide elements 31 are preferably formed on the housing 28, so that a feedthrough gap 32 remains between the wringer roller 27 and the guide elements 31. The gap width is adapted to the thickness of a carrier plate 19 that is fitted with the mop cover 22.

FIG. 1 shows two operating states for the mop carrier 03 and the wringer 04 of the cleaning system according to the invention. In a first operating state the mop carrier 03 and the wringer 04 are illustrated by solid lines. For rinsing out the mop cover, the mop carrier 03 is situated in the container 02, with the carrier plate 19 positioned with its bottom side in the vicinity of the base surface 06 of the container 02. As a result, the mop cover 22, which spans the bottom side of the carrier plate 19, is wetted or rinsed with cleaning liquid. The wringer 04 is placed in the wringer holder 12 where it is held in a form-fit manner, so that the operating handle 30 points vertically upward. This position may be referred to as a neutral position of the wringer 04 when the wringer 04 is not needed at that moment. However, this position of the wringer is also used to move the container 02. Namely, when a force is introduced, via the operating handle 30, into the wringer 04 which is in the neutral position, this force acts on the container via the wringer holder. A torque that acts, for example, about the wringer roller 27 (in the counterclockwise direction with reference to FIG. 1) results in swiveling of the container 02 about the rotational axis that extends through the wheels 17, so that the support feet 18 no longer contact the standing surface. That is, the user may then move the container 02 on the two wheels 17, with the user introducing the required force on the operating handle 30 of the wringer with one hand.

The second operating state is depicted by the dash-dotted illustration of the mop carrier 03 and the wringer 04. The mop carrier 03 and the wringer 04 are hereby positioned on the container 02 in order to wring out the mop cover 22 after the wetting or rinsing. For this purpose, the mop carrier 03 is fixed in the mop carrier holder 14, as the result of which the carrier plate 19 is oriented essentially vertically, in parallel to the inner surface of the second side wall section 13. A portion of the excess cleaning liquid drops downwardly into the container 02 solely due to the force of gravity. The user may now use the operating handle 30 to remove the wringer 04 from the wringer holder and move it toward the mop carrier, in particular over the container 02, so that any cleaning liquid dripping from the wringer is collected by the container 02. The wringer 04 is then placed on the upwardly directed end of the carrier plate 19 of the mop carrier 03, and is displaced on the carrier plate 19 in the direction of the base surface 06 of the container 02. During the displacement of the wringer 04 along the carrier plate 19, the wringer roller 27 contacts the mop cover 22, while the guide elements 31 on the opposite side of the carrier plate 19 come to rest on their edges. Due to the adjusted width of the feedthrough gap 32, the wringer roller 27 squeezes excess cleaning liquid from the mop cover 22. The user guides the wringer downwardly on the mop carrier once. The wringer 04 may be subsequently put back in the wringer holder.

Figure 2:
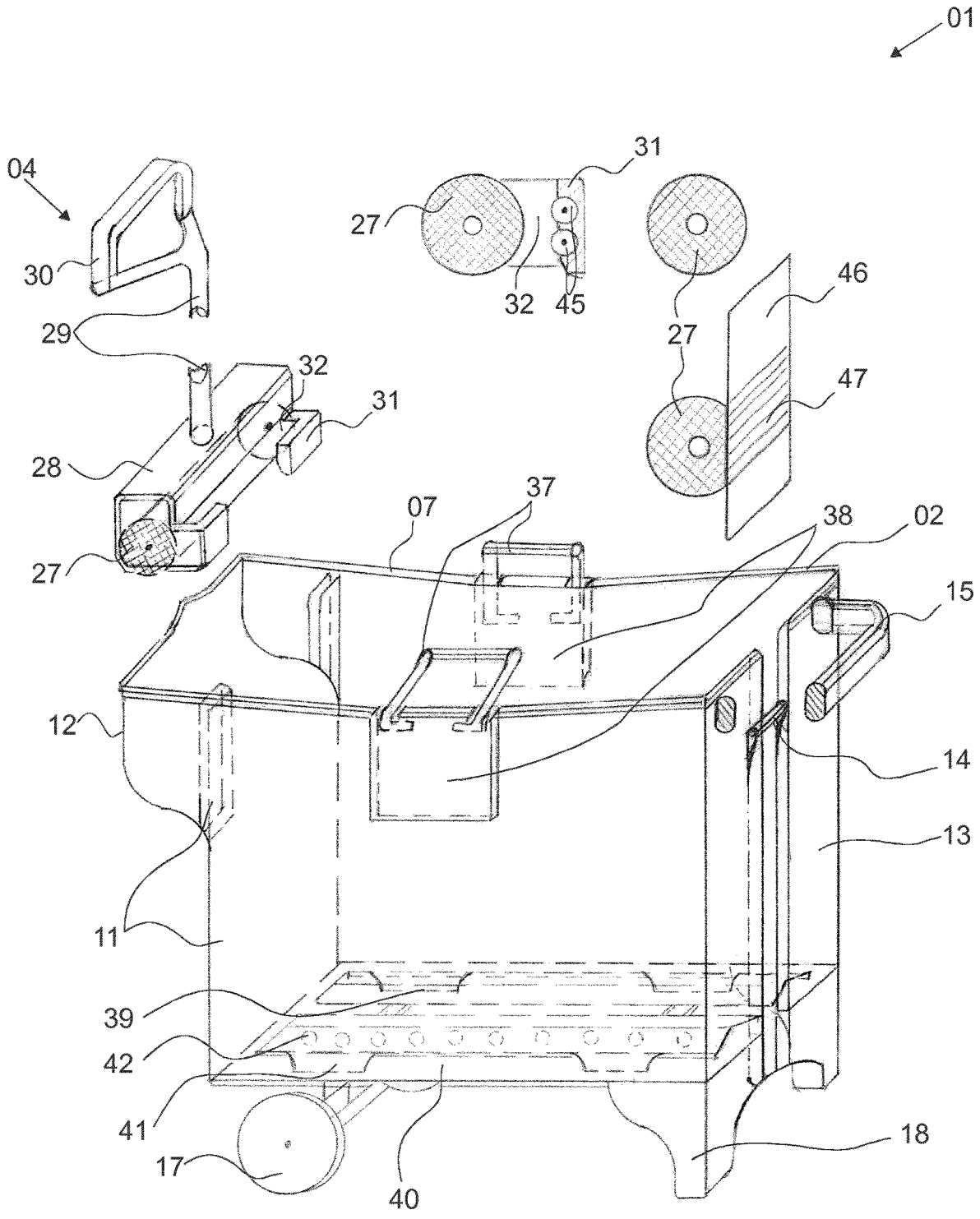
FIG. 2 shows a perspective view of the cleaning system with detail illustrations.

FIG. 2 shows details of the cleaning system 01. Two handles 37 are mounted on the container 02 in the vicinity of the top edge 07. The handles 37 are oppositely situated on side wall sections, adjacent to the side wall sections 11, 13 on which the wringer holder and the mop carrier holder 12, 14 are provided. The handles 37 preferably have a C-shaped design, and, for example, may be hooked on a rim of the top edge 07 by gripping over. Indentations 38 in the side wall sections are used for accommodating the handles 37 when they are not needed by the user.

FIG. 2 also shows a dirt separator 39 that is detachably placed on a base surface top side 40 of the container 02, with spacers 41 provided toward the base surface top side. The dirt separator 39 is designed as a separating plate 39 [sic] having separating plate openings 42; i.e., the dirt separator 39 is permeable to cleaning liquid and is removable from the container 02. The separating plate openings 42 are designed as holes and/or slots. The dirt separator 39 allows dirt particles to collect on the base surface top side 40, and at the same time prevents them from being swirled up once again during rinsing of the mop carrier 03.

FIG. 2 also shows that the wheels 17 may be spaced apart from an outer edge of the wringer holder 12. The spacing causes the rotational axis of the wheels to be displaced in the direction of the support feet 18, starting from the outer edge of the wringer holder 12, by up to 40%, particularly preferably by 30%, of the total length of the container 02. The tilting of the container 02 by the introduction of force into the wringer 04 is facilitated by the displacement of the wheels 17.

The wringer 04 shown in FIG. 2 differs from that shown in FIG. 1 with regard to the configuration of the guide elements 31. To this end, a sectional detail illustration in the upper right portion of FIG. 2 shows that two guide rollers 45 are situated in the guide element 31. The rotational axes of the guide rollers 45 are situated in parallel to the axis of the wringer roller 27. Each guide roller 45 is equidistantly spaced from the rotational axis of the wringer roller 27. FIG. 2 shows, on the circumference 46 of a wringer roller 27 on which rolling takes place, a resulting contact surface 47 of the wringer roller 27 with respect to the mop cover 22 on the carrier plate 19 of the mop carrier 03.

Figure 3:
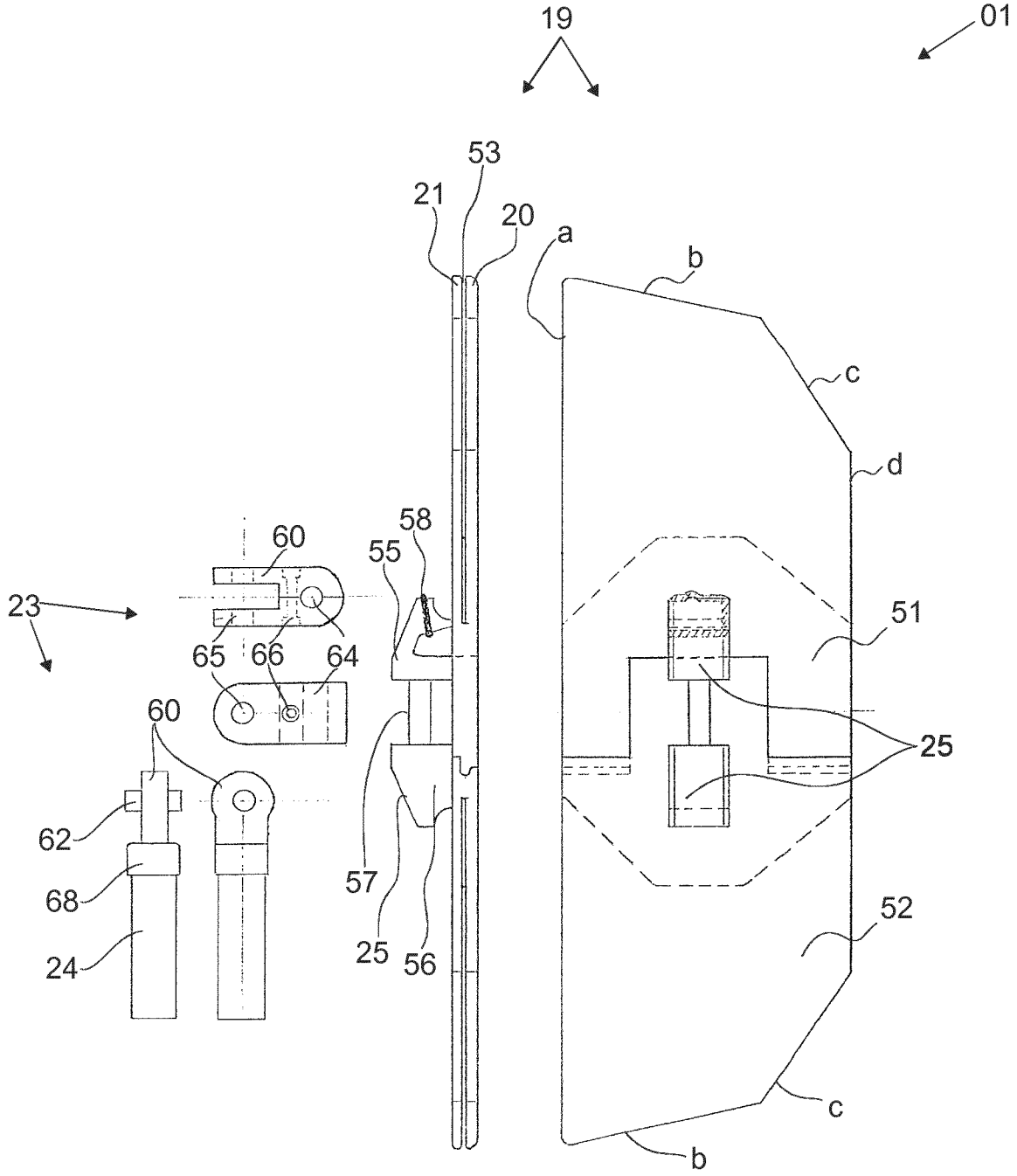
FIG. 3 shows a preferred embodiment of a mop carrier of the cleaning system, in a side view and a top view.
Figure 4:
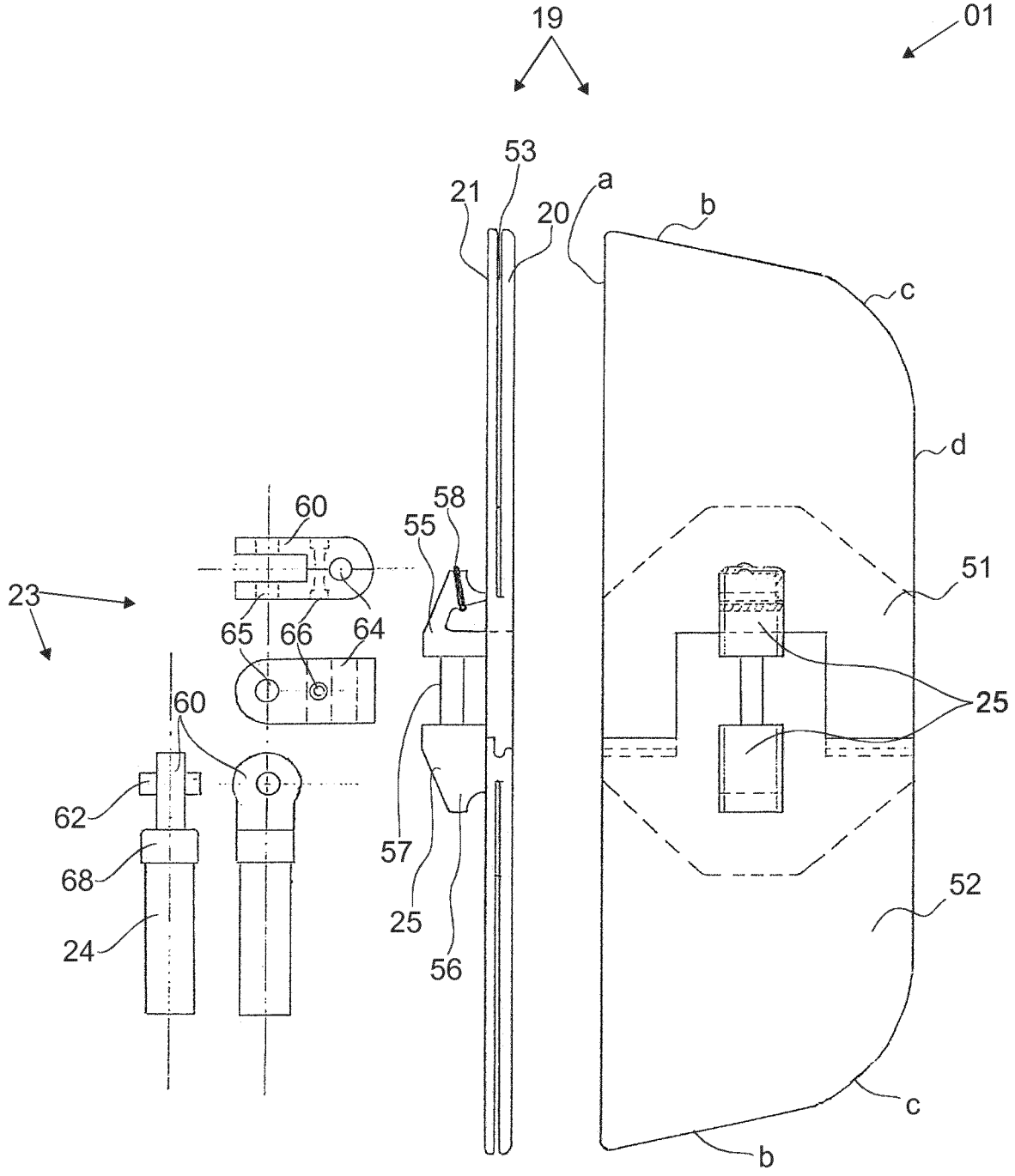
FIG. 4 shows a modified embodiment of the mop carrier of the cleaning system, in a side view and a top view.

FIGS. 3 and 4 show views of preferred embodiments of the carrier plate 19 of the cleaning system 01. In each case a top view and a side view of the carrier plate 19 are shown, as well as the articulated joint 23 for connecting the carrier plate 19 to the rod handle (not illustrated). The carrier plate 19 is divided into a first and a second carrier plate section 51, 52. The two carrier plate sections 51, 52 are connected to one another by a carrier plate joint (not illustrated), so that the carrier plate sections 51, 52 are foldable and detachable. A receiving gap 53 is formed between the top side 20 and the bottom side 21 of the carrier plate 19. The retaining means 25 is centrally situated on the top side 20 of the carrier plate 19. The retaining means 25 has a first, a second, and a third retaining means section 55, 56, 57. The first and the second retaining means section 55, 56 are connected to the carrier plate 19, and are designed for guiding the carrier plate 19 with a fit with respect to the mop carrier holder 14. The first retaining means section 55, in comparison to the second retaining means section 56, has a recess and a retaining clamp 58. The retaining clamp 58 has a detachable design for fitting the carrier plate 19 with the mop cover 22. The third retaining means section 57 is designed as a connection between the first and the second retaining means section 55, 56 and for accommodating the articulated joint 23. The articulated joint 23 has a first and a second articulated joint section 60 that are connected by a bolt 62. The first articulated joint section 60 has a first through opening 64 for passing the third retaining means section 57 through. A second through opening 65 is rotated by 90° and is spaced apart from the first through opening 64, and is designed for accommodating the bolt 62. The first articulated joint section 60 has a design that is dividable along the pass through direction of the first through opening 64, and is connectable by a screw (not shown) via a third through opening 66. In addition, the second articulated joint section has a connecting piece 68 for connection to the rod handle 16 of the mop carrier 03.

FIG. 3 shows the carrier plate 19, which in the top view has the shape of a hexagon and has the sides a, b, c, d. The sides b adjoin the longest side a at an acute angle. The sides c adjoin the sides b at an obtuse angle, and are likewise adjoined by the side d at an obtuse angle, which is then parallel to the side a. The corners of the sides a, b are rounded by radii. The corners of the other sides may likewise have radii. In contrast to FIG. 3, in FIG. 4 the sides c are designed as a section of a circular arc.

Figure 5:
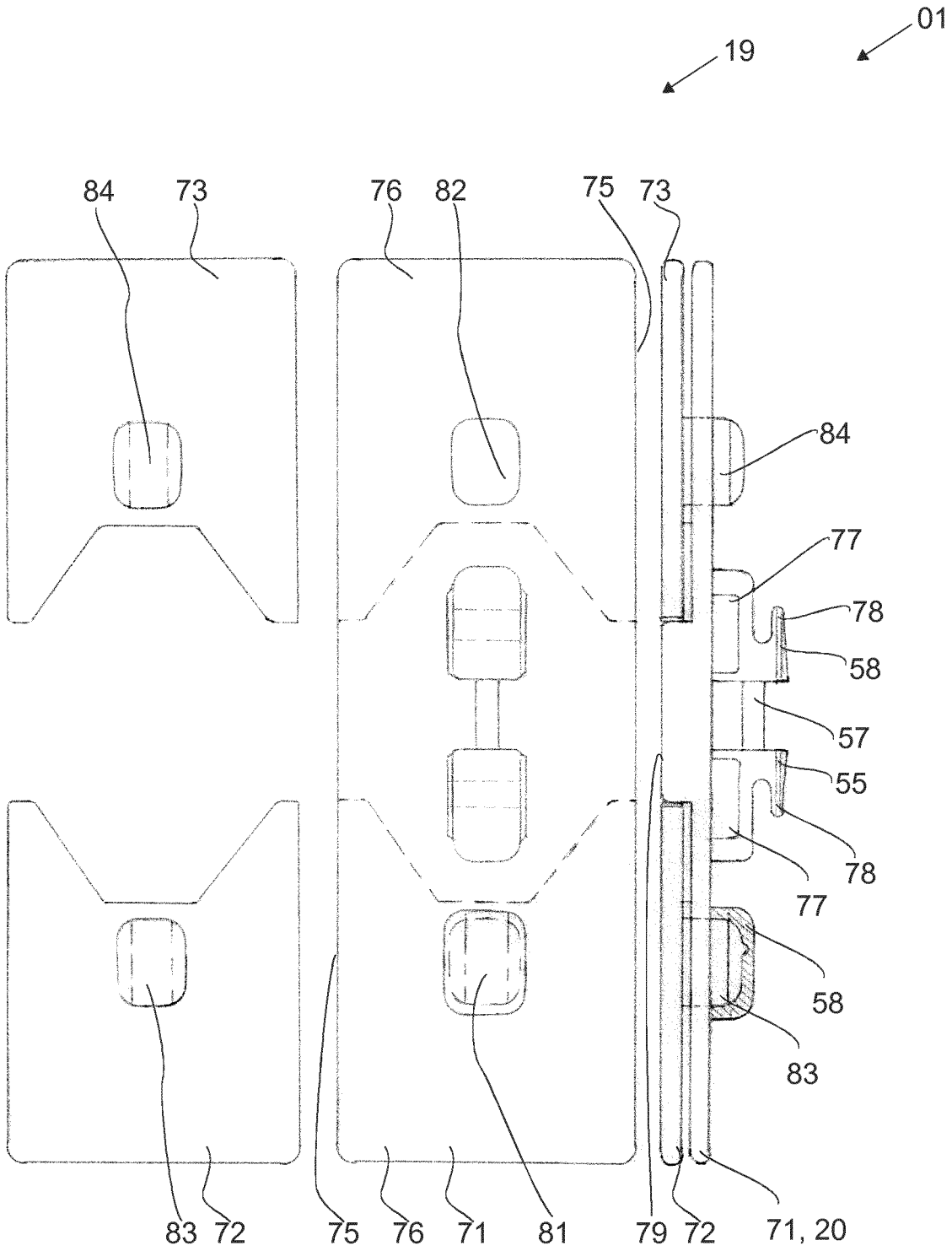
FIG. 5 shows another embodiment of the mop carrier of the cleaning system in a side view, bottom view, and top view.

FIG. 5 shows another preferred embodiment of the carrier plate 19 of the mop carrier. The carrier plate 19 in this case has a rectangular shape, and has a third, a fourth, and a fifth carrier plate section 71, 72, 73 that are designed to be detachable from one another. Two longer sides 75 and two shorter sides 76 are situated opposite one another. The corners of the carrier plate are rounded by radii, but may also have a beveled design. The third carrier plate section 71 forms the top side 20 of the carrier plate 19 on which the retaining means 25 is centrally situated. The first and the second retaining means sections 55, 56 are designed with a stop 77 and a tab 78 that points away from the center. The third retaining means section 57 connects the first two retaining means sections, and is designed for accommodating the articulated joint, which is preferably a double joint. The third carrier plate section 71 has a downwardly and centrally formed first protrusion 79. The first protrusion 79 extends from one longer side to the other longer side 75, and in the direction of the shorter sides 76 the first protrusion 79 has at least a width that allows cooperation with the retaining means 25. A fifth and a sixth through opening 81, 82 having a rectangular basic shape and rounded corners are formed on the top side 20 of the carrier plate 19. In a complementary manner, formed on the fourth and fifth carrier plate sections 72, 73 are a second and a third protrusion 83, 84, on top, for passing through the fifth and sixth through openings 81, 82. The protrusion 83 is placed on the fourth carrier plate section, passed through the fifth through opening 81, and above the third carrier plate section 71 is fixed with a mounting 58, for example in the form of a retaining clamp 58.

Figure 6:
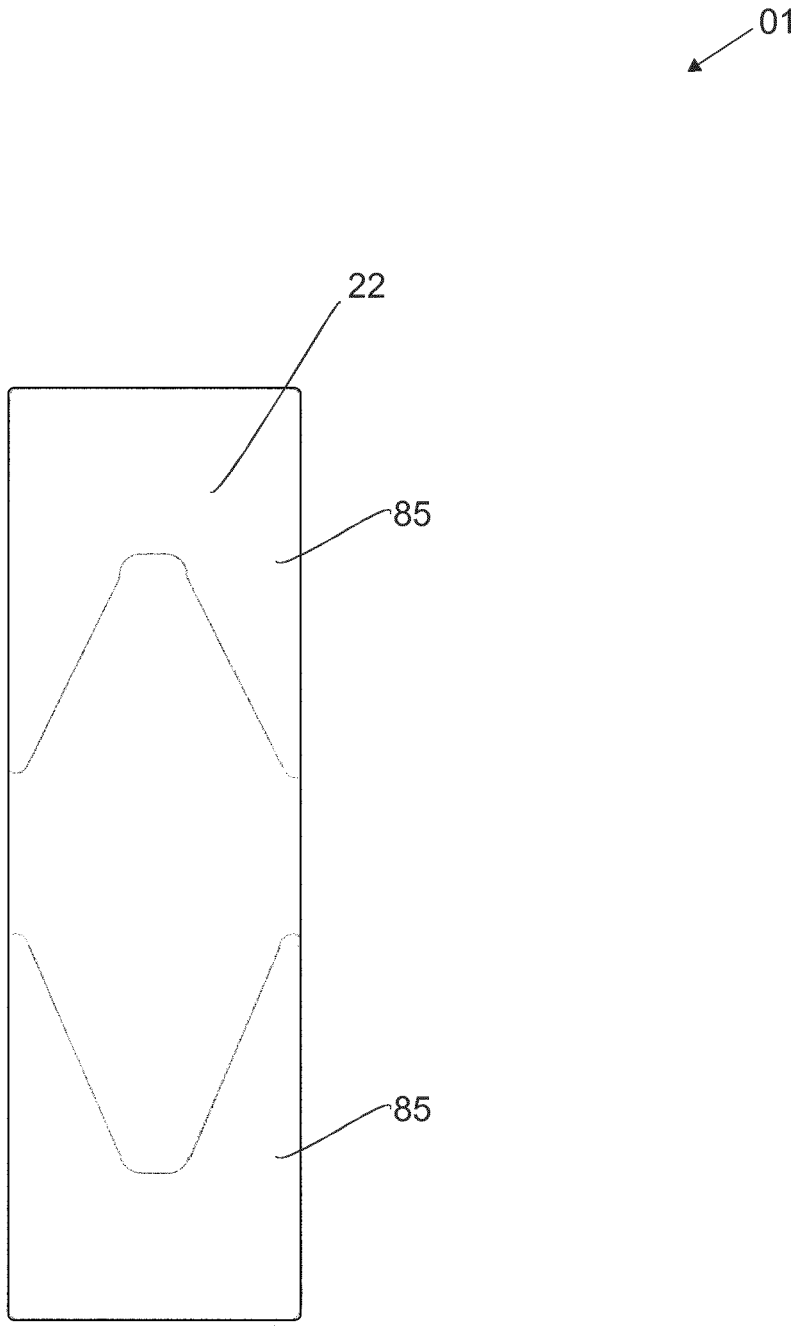
FIG. 6 shows a top view of a preferred embodiment of a mop cover that is compatible with the mop carrier of the cleaning system.

FIG. 6 shows the top view of a preferred embodiment of the mop cover 22. The mop cover 22 has a downwardly directed side for mopping, and an upwardly directed side having holding pockets 85 for fastening the mop cover 22 to the carrier plate 19. In the embodiment shown, the mop cover has a rectangular shape according to the carrier plate 19 shown in FIG. 5; the embodiments of the mop cover 22 may vary according to other carrier plate shapes.

The invention claimed is:

1. A cleaning system for cleaning floors, comprising:

a container that has a base surface at the bottom, a top edge at the top, an opening, and side walls that are integrally formed on the base surface, and that is designed for holding a cleaning liquid;

a wringer holder is provided on a first side wall section and a mop carrier holder provided on a second side wall section;

a plurality of wheels situated on a bottom side of the base surface, wherein at least two of the plurality of wheels are situated beneath the first side wall section that bears the wringer holder;

a mop carrier having a carrier plate with a top side and a bottom side, an articulated joint, and a rod handle that is fastened to the articulated joint, wherein the carrier plate is designed to accommodate a mop cover that covers the bottom side;

a retaining means is situated on the top side of the carrier plate with a shape that conforms to the mop carrier holder, so that the mop carrier is fixable to the mop carrier holder; and a wringer having a wringer roller, a housing that partially encloses the wringer roller, and a shaft with an operating handle fastened to the housing, wherein guide elements are provided on the housing such that a feedthrough gap remains between the wringer roller and the guide elements, the gap width of which is adapted to the thickness of the carrier plate of the mop carrier fitted with the mop cover, and wherein the wringer is mountable on the carrier plate of the mop carrier and displaceable on the mop carrier in the direction toward the base surface of the container, while the mop carrier is fixed in the mop carrier holder so that the wringer roller presses the mop cover against the carrier plate when the mop carrier is relatively moved through the feedthrough gap, and further wherein the wringer is placeable in a form-fit manner in the wringer holder, so that a force introduced at the operating handle of the wringer causes the container to swivel about a rotational axis that is coaxial with respect to the wheel axes of at least two of the wheels that are situated below the first side wall section.

2. The cleaning system according to claim 1, further comprising a detachable dirt separator on a base surface top side of the container designed as a separating plate with separating plate openings and spacers directed toward the base surface top side.

3. The cleaning system according to claim 1, wherein the container has at least one handle on at least one side wall.

4. The cleaning system according to claim 1, wherein the wringer holder is designed as a protrusion formed as one piece in the first side wall section of the container.

5. The cleaning system according to claim 1, wherein the mop carrier holder is formed as a recess that is introduced into the second side wall section of the container.

6. The cleaning system according to claim 1, wherein the plurality of wheels comprises two wheels and the system further comprises two support feet, opposite from the two wheels mounted on the bottom side of the base surface, spaced apart from the rotational axis.

7. The cleaning system according to claim 1, wherein the articulated joint for connecting the carrier plate to the rod handle of the mop carrier is designed as a double joint, and further articulated joints on the carrier plate are designed for dividing the carrier plate into a first and a second carrier plate section.

8. The cleaning system according to claim 1, wherein the carrier plate has a multipart design made up of carrier plate elements that are detachably joined by connecting means.

9. The cleaning system according to claim 1, wherein each of the guide elements of the wringer has at least one guide roller that is situated opposite from and in parallel to the wringer roller, and the wringer roller is made of an elastic material.

10. The cleaning system according to claim 1, wherein at least one of the plurality of wheels that is situated on the base surface has a locking brake.

* * * * *